US006683413B2

(12) United States Patent
Okubo et al.

(10) Patent No.: US 6,683,413 B2
(45) Date of Patent: Jan. 27, 2004

(54) HIGH PRESSURE DISCHARGE LAMP OF THE SHORT ARC TYPE

(75) Inventors: Keisuke Okubo, Himeji (JP); Mitsuru Ikeuchi, Himeji (JP); Shoji Miyanaga, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 98 days.

(21) Appl. No.: 10/089,687

(22) PCT Filed: Jul. 30, 2001

(86) PCT No.: PCT/JP01/06523

§ 371 (c)(1),
(2), (4) Date: Apr. 3, 2002

(87) PCT Pub. No.: WO02/13229

PCT Pub. Date: Feb. 14, 2002

(65) Prior Publication Data

US 2003/0020403 A1 Jan. 30, 2003

(30) Foreign Application Priority Data

Aug. 3, 2000 (JP) ..... 2000-235180
Jul. 13, 2001 (JP) ..... 2001-213612

(51) Int. Cl.[7] ..... H01J 61/073
(52) U.S. Cl. ..... 313/574; 313/491; 313/631
(58) Field of Search ..... 373/574, 491, 373/631

(56) References Cited

U.S. PATENT DOCUMENTS

| | | | |
|---|---|---|---|
| 3,248,591 | A | 4/1966 | Arndt |
| 5,874,805 | A | 2/1999 | Kavanagh |
| 5,929,565 | A | 7/1999 | Mayama et al. |
| 6,211,615 | B1 | 4/2001 | Altmann et al. |

FOREIGN PATENT DOCUMENTS

| | | |
|---|---|---|
| EP | 1 047 109 A1 | 10/2000 |
| GB | 2 107 921 A | 5/1983 |
| JP | 60-48663 | 4/1985 |
| JP | 60-110973 | 7/1985 |
| JP | 11-102662 | 4/1999 |

*Primary Examiner*—Vip Patel
(74) *Attorney, Agent, or Firm*—Nixon Peabody LLP; David S. Safran

(57) ABSTRACT

The object of the invention is to improve the thermal radiation characteristic of the electrodes in a high pressure discharge lamp of the short arc type in which the input power has been increased in order to increase the amount of radiant light, and to reduce the electrode temperature with high efficiency.

The object is achieved as claimed in the invention in a high pressure discharge lamp of the short arc type in the emission tube of which there is a pair of electrodes, in that at least part of the sides of the above described electrodes is provided with a groove area, that the depth D of this groove area is within 12% of the electrode diameter and that the relation D/P is between the depth D of the groove area and the pitch P between the grooves is greater than or equal to 2.

11 Claims, 4 Drawing Sheets

| Angle of V-groove (°) | Depth of groove/ groove pitch (D/P) | Heat emission by V-groove |
|---|---|---|
| 10 | 5.72 | 0.88 |
| 20 | 2.84 | 0.79 |
| 30 | 1.87 | 0.72 |
| 40 | 1.37 | 0.66 |
| 50 | 1.07 | 0.61 |
| 60 | 0.87 | 0.57 |
| 70 | 0.71 | 0.54 |
| 80 | 0.60 | 0.51 |
| 90 | 0.50 | 0.49 |
| 180 | 0.00 | 0.40 |

| Depth of V-groove (mm) | Depth of groove/ groove pitch (D/P) | Heat emission by V-groove (measured value) |
|---|---|---|
| 1.5 | 3.0 | 0.79 |
| 1.0 | 2.0 | 0.70 |
| 0.75 | 1.5 | 0.65 |
| 0.5 | 1.0 | 0.57 |
| W paste (conventional example) | ——— | 0.60 |
| starting material (untreated) | ——— | 0.41 |

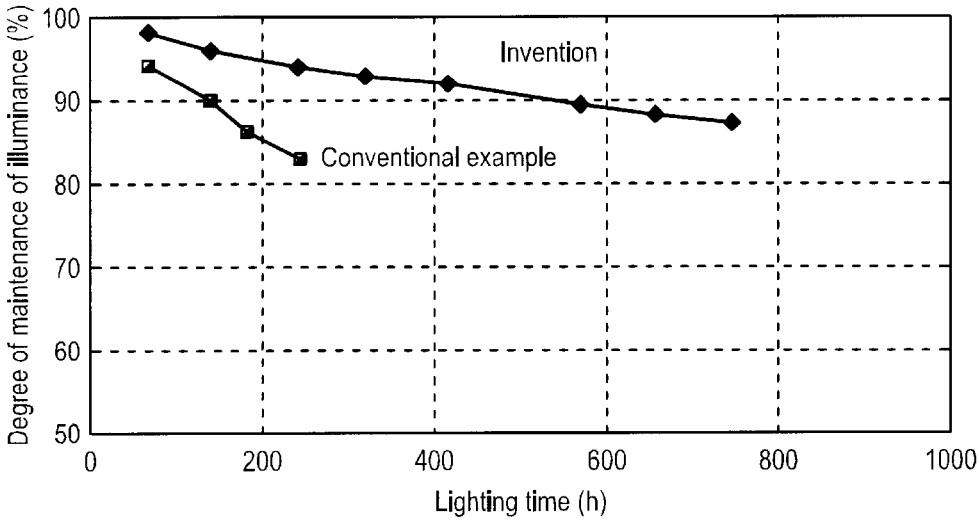
Fig.7
Anode
| Depth of V-groove (mm) | Number of anomalous discharges | Degree of development (%) |
|---|---|---|
| 0.5 | 0 | 0 |
| 0.75 | 3 | 7.5 |
| 1.0 | 10 | 20 |
| 1.5 | 20 | 40 |
Fig.8(a)
Cathode
| Depth of V-groove (mm) | Number of anomalous discharges | Degree of development (%) |
|---|---|---|
| 0.5 | 3 | 6 |
| 0.75 | 10 | 20 |
| 1.0 | 25 | 50 |
| 1.5 | 33 | 66 |
Fig.8(b)
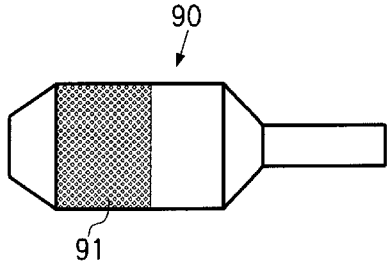
Fig.9
(Prior Art)

HIGH PRESSURE DISCHARGE LAMP OF THE SHORT ARC TYPE

BACKGROUND OF THE INVENTION

1. Field of the Invention

The invention relates to a high pressure discharge lamp of the short arc type. The invention relates especially to the side shape of the electrodes of a high pressure discharge lamp of the short arc type.

2. Description of the Prior Art

Recently a high pressure discharge lamp of the short arc type has been used for example as a light source in a photolithography process which is a production process for a liquid crystal color filter. The radiant light used here contains an intensive line spectrum at a wavelength of 365 nm or a wavelength of 436 nm.

On the other hand, there is a market demand for enlargement of the color filter and a shortening of the exposure duration. Furthermore, there is a demand for an increase in the amount of radiant light of the high pressure discharge lamp of the short arc type and especially an increase in the amount of radiant light at a wavelength in the vicinity of 365 nm is greatly desired.

Conventionally, it is known that the amount of radiant light of a high pressure discharge lamp of the short arc type is in a proportional relationship to the electrical input for a discharge lamp. This means that the amount of radiant light can also be increased when the electrical input for the discharge lamp is increased. To increase the electrical input for the discharge lamp there are the following methods:

1. increase the distance between the electrodes and thus the emission length of the high pressure discharge lamp of the short arc type
2. increase the amount of mercury to be added to the discharge lamp and thus operate the lamp in a state with a higher overpressure
3. increase the input current for the discharge lamp The above described methods however have the following defects:

For Method I:

The emission part becomes larger than in the normally used point light source lamp due to the increase in the emission length. In the case of use as a light source in an exposure device for photolithography a point light source is desirable in conjunction with an irradiation optics system. The above described prolongation of the emission length is therefore not suited for a light source of this exposure device. It can no longer be used in practice, even if the amount of radiant light is improved.

For Method 2:

Since the internal pressure of the high pressure discharge lamp of the short arc type becomes great, there is a problem with respect to the mechanical strength of the emission tube. In a conventional high pressure discharge lamp of the short arc type there are many cases of a construction in which the vapor pressure of the contained mercury during operation is a pressure which approaches the upper limit of the internal pressure intensity of the lamp. In operation with a high pressure which is higher than the above described pressure, a high pressure discharge lamp of the short arc type is destroyed. This means that the method in which the amount of mercury added is increased more than in a conventional high pressure discharge lamp of the short arc type and in which the lamp is operated with a higher overpressure cannot be used to increase the amount of radiation.

In Method 3:

When the lamp current increases, the peak area of the anode is heated by the increase of the electron emission current; this leads to an increase in the temperature of the anode part. Of the heat generated in the anode there is normally heat which is emitted to the outside by heat conduction of the anode and heat which is emitted to the outside from the anode surface by radiation. In the method in which the lamp current is increased however the heat emitted to the outside is insufficient compared to heating by the increase of the electron emission current. As a result, thermal vaporization of the anode component is accelerated as a result of the temperature increase of the anode. This results in the disadvantages of blackening of the inside wall of the emission tube, shortening of the lamp service life, and similar disadvantages.

To eliminate these disadvantages a process was proposed in which the efficiency of thermal radiation from the anode is increased and in which the anode temperature is reduced.

For example, Japanese patent disclosure document SHO 39-11128 discloses that the anode side is provided with grooves with a V-shaped structure. Specifically it is described that there are cooling grooves with a depth of roughly 1 mm to 3 mm and an opening angle of 90°, that at the same time tantalum carbide is sintered onto the surfaces of these cooling grooves and that in this way the thermal irradiation from this anode surface is increased even more. In this process however there were the disadvantages that depending on the anode temperature carbon is released, that in this way blackening of the emission tube of the high pressure discharge lamp of the short arc type occurs or that carbon migrates to the electrode tip and that the electrode melts.

Furthermore, Japanese patent disclosure document HEI 9-231946 discloses that tungsten powder is sintered onto the anode side and that the heat emission capacity of the electrode surface is increased. FIG. 9 shows this arrangement. In a given surface area of an anode 90 fine-particle tungsten sinter layers 91 are formed. These fine tungsten particles have a grain size from roughly 0.1 microns to 100 microns. The area is enlarged by the measure that the anode surface is provided with them as sinter layers. This arrangement increases the amount of thermal radiation from the electrode surface. The attempt is made to lower the electrode temperature by this measure.

In this arrangement the thermal radiation from the electrode can be increased compared to the case in which a tungsten powder is not applied. When the electrical input for the discharge lamp is increased more, the cooling of this electrode however becomes insufficient. As a result the disadvantage is that the heat emission from the electrode is insufficient.

SUMMARY OF THE INVENTION

The object of the invention is to improve the thermal radiation characteristic of the electrodes in a high pressure discharge lamp of the short arc type in which the input power for the lamp has been increased to increase the amount of radiant light and to reduce the electrode temperature with high efficiency. Furthermore, the object of the invention is to be able to suppress or reduce vaporization of the electrode material from the tip area of the anode by reducing the electrode temperature with high efficiency, and to be able to reduce wear, thermal distortion and the like of the electrode tip and as a result to keep the emission of the discharge lamp stable over a long time.

The object is achieved as claimed in the invention in a high pressure discharge lamp of the short arc type, in the emission tube of which there is a pair of electrodes, in that at least part of the side of the above described electrode is provided with a groove area, that the depth D of this groove area is within 12% of the electrode diameter and that the relation D/P between the depth D of the groove area and the pitch P between the grooves is greater than or equal to 2.

The object is achieved as claimed in the invention in that the above described groove area consists of V-shaped grooves.

This object is moreover achieved as claimed in the invention in that the bottom area and/or the uppermost area of the above described groove area is/are provided with a curved surface.

The object is moreover achieved as claimed in the invention by providing the tip of the above described electrode with a conical part in which the above described groove area is formed.

The invention is further described below using several embodiments shown in the drawings.

FIG. 1 shows an overall view of a high pressure discharge lamp of the short arc type;

FIGS. 2(*a*)–(*c*) each show a schematic of the anode of a high pressure discharge lamp of the short arc type as claimed in the invention in an enlargement;

FIGS. 3(*a*)–(*e*) each show a schematic of one embodiment of the anode of a high pressure discharge lamp of the short arc type as claimed in the invention;

FIG. 7 shows a schematic of the action of a groove arrangement as claimed in the invention;

FIG. 8 shows schematics of the action of a groove arrangement as claimed in the invention; and FIG. 9 shows a schematic of a conventional electrode arrangement.

DETAILED DESCRIPTION

Figure 1:
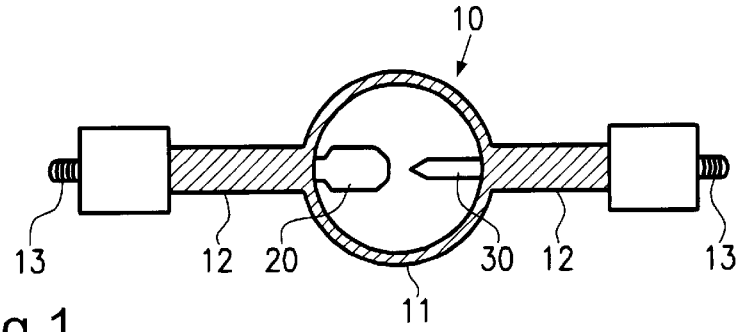
Figure 2A:
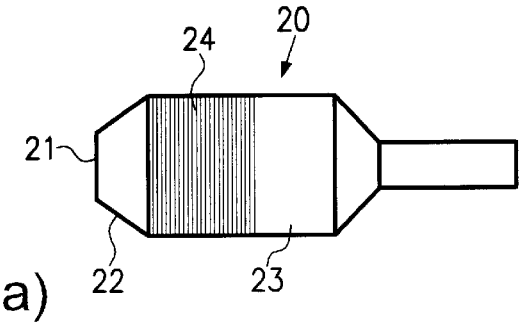
Figure 2B:
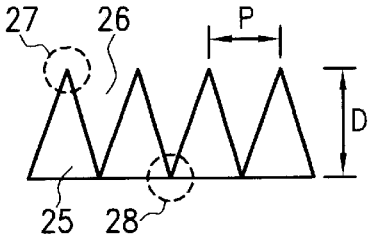
Figure 2C:
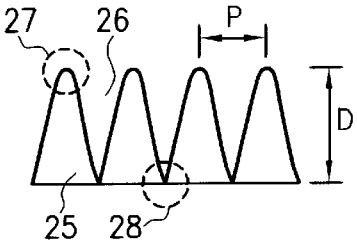
Figure 3A:
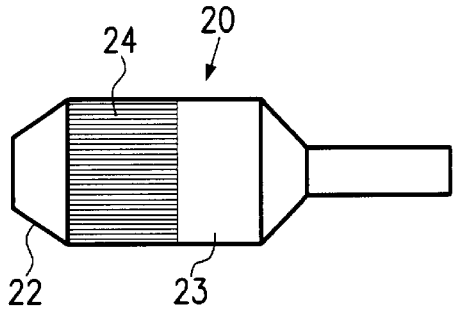
Figure 3B:
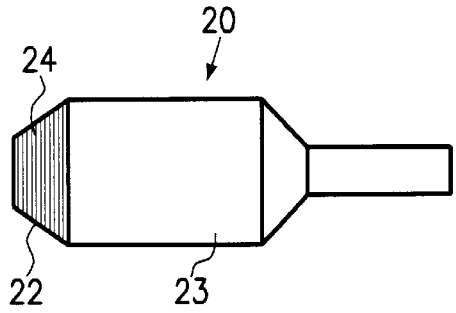
Figure 3C:
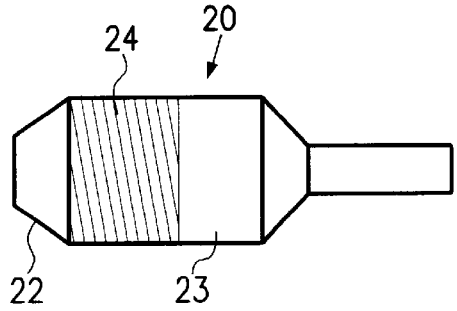
Figure 3D:
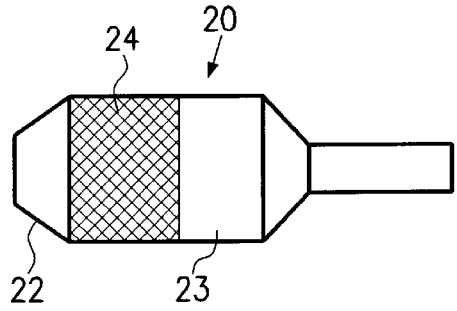
Figure 3E:
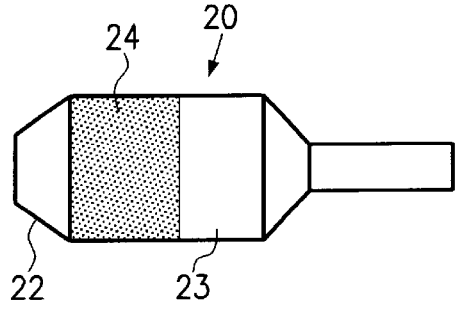

FIG. 1 shows an overall view of a high pressure discharge lamp of the short arc type. Reference number 10 labels a discharge lamp which consists of an emission tube portion 11 and hermetically sealed tube portions 12. In the emission tube portion 11 there are an anode 20 and a cathode 30 opposite one another, consisting of tungsten, with a tip distance to one another of roughly 10 mm. The anode 20 and the cathode 30 are each installed in the hermetically sealed tube portion 12 and are electrically connected to the outside terminals 13. The emission tube portion 11 is filled with a rare gas such as xenon, argon, krypton or the like or a filling gas consisting of a mixture thereof and an emission substance such as mercury or the like. The pressure of the filling gas during filling is for example 0.1 atm to 10 atm. The amount of mercury added is from 10 mg/cm$^3$ to 60 mg/cm$^3$ at the weight per internal volume of the emission tube portion 11. This discharge lamp is operated for example with a rated voltage of 50 V and a rated output of 5 kW. FIGS. 2(*a*) to (*c*) each show the anode 20 in an enlarged view. FIG. 2(*a*) is a side view of the shape of the anode 20. FIGS. (*b*) and (*c*) each show a groove area formed on the anode side in an enlarged cross section.

In FIG. 2(*a*) the anode 20 consists of a tip area 21, a conical part 22 and a body part 23. The tip area 21 is made planar and is opposite the cathode. The conical part 22 is provided with a taper which connects the tip area 21 to the body part 23. The side of the body part 23 is provided with a V-shaped groove area 24. The numerical values of the anode are described below by way of example:

The body part 23 has a diameter of 25 mm and a length of 45 mm. The opening angle of the conical part 22 is 120°. The diameter of the tip area 21 is 8 mm.

In FIG. 2(*b*) the groove area 24 is formed in a V shape from convex areas 25 and concave parts 26. The corner point of the convex area 25 is provided with an uppermost part 27. The bottom of the concave area 26 is provided with a bottom area 28. The distance between the uppermost parts 27 of the adjacent convex areas 25 forms the distance P between the grooves. The distance between the uppermost part 27 and the bottom area 28 forms the depth D of the grooves. In the arrangement shown in FIG. 2(*b*) the uppermost part 27 of the convex area 25 and the bottom area 28 of the concave area 26 are made pointed, resulting in a completely V-shaped arrangement overall. This V-shaped arrangement yields the advantages that the foot is made wide and thus the shape is stable and that no change of shape or the like occurs. The numerical values are given by way of example below:

The distance P between the grooves is for example 0.5 mm. The depth D of the grooves is for example 1.5 mm. In the area of a 40 mm side of the anode 20 there are 80 grooves.

FIG. 2(*c*) likewise shows the groove area of the body part 23 enlarged. The difference from FIG. 2(*b*) is however that the uppermost are 27 and the bottom area 28 are not pointed, but are made curved flat. This arrangement yields the advantage that concentration of the electrical field when operation starts can be prevented, as described below.

The arrangement of the grooves formed in the anode is however not limited to the arrangements shown in FIGS. 2(*a*) to (*c*).

FIGS. 3(*a*) to (*e*) each show by way of example another embodiment of the groove arrangement. FIG. 3 shows the groove direction of the groove area 24 with which the body part 23 of the anode is provided, not the circular peripheral direction of the anode 20. The groove area 24 is made in the direction in which the anode 20 extends. In FIG. 3(*b*) the groove area 24 is formed, not in the body part 23, but in the conical part 22. Furthermore, the groove area 24 can also be located both in the conical part 22 and also in the body part 23. In FIG. 3(*c*) the grooves of the groove area 24 located in the back part 23 run in the spiral direction. Here the grooves are formed connected in one row to one another. In FIG. 3(*d*) the groove area 24 located in the body part 23 is made mesh-like. The groove direction is not limited to the direction shown in FIG. 3(*d*). Furthermore it can be combined with the groove arrangements shown in FIGS. 3(*a*) and (*b*). Moreover, the spiral grooves shown in FIG. 3(*c*) can be placed twice and thus mesh-like grooves can be formed. In FIG. 3(*e*) in the body part 23 the groove area 24 is formed from any number of grooves 24. As a result of the arbitrary "line drawing" irradiation with laser light irregular grooves are formed in the body part 23. The laser irradiation is therefore done in an irregular direction with respect to the surface of the body part 23.

In the invention the term "side" of the electrode will be defined not only as the body part, but also the conical part. In the above described embodiments (FIG. 2(*a*), FIGS. 3(*a*), (*b*), (*c*), (*d*), and (*e*)) the groove area 24 is located in the forward area of the body part 23. But it can also be formed in the overall area of the side of the body part 23 or also in a single certain area. The shape of the conical part is not limited to the shape of a truncated cone, but also contains a curved shape.

The above described embodiments show for example a case in which the anode 20 is provided with a groove area 24. But the same groove area can likewise be located in the cathode. Furthermore, in a discharge lamp which is operated using alternating current, the groove area described above by way of example can also be located in one electrode or the two electrodes. The groove arrangement as claimed in the invention is limited not only to the above described arrangements, but also comprises other arrangements.

In the high pressure discharge lamp of the short arc type as claimed in the invention, the arrangement of the above described groove arrangement in the electrode (in the electrodes) does improve the heat emission capacity of the electrode(s). But it can be added that this action can be increased even more by fixing the relation between the groove distance and the groove depth.

Figures 4, 5, 6:
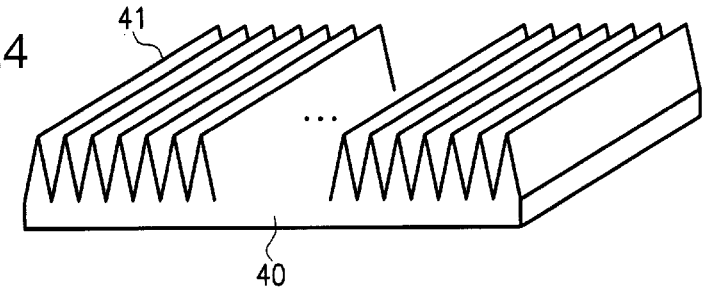
FIG. 4 shows a schematic of the action of a groove arrangement as claimed in the invention.
FIG. 5 shows a schematic of the action of a groove arrangement as claimed in the invention.
FIG. 6 shows a schematic of the action of a groove arrangement as claimed in the invention.

This circumstance is described below. A model is presented here in which the electrode does not have a cylindrical shape, but in which the plate is provided with a groove structure. In FIG. 4 the plate 40 is provided with a groove area 41 with the same arrangement as the one shown in FIGS. 2(*a*), (*b*), and (*c*). In this case the relation between the groove pitch P of the groove area 41, the groove depth D and the heat emission capacity is described by the following formula:

$$\epsilon=\epsilon_0/[1-(1-\epsilon_0)\{1-\sin(\alpha/2)\}] \quad \text{(Formula 1)}$$

Here "$\epsilon_0$" is the emission capacity typical for the material and in the case of using tungsten as the electrode material it is roughly 0.4. It furthermore designates $\alpha$ the angle which is formed in the uppermost area or in the bottom area of the groove area. It has been effectively observed that the emission capacity $\epsilon$ becomes greater, the smaller $\alpha$ becomes, and that a small value of $\alpha$ means a case in which the ratio of the groove pitch P to the groove depth D, i.e. D/P, is large.

FIG. 5 shows the relation between the angle and the heat emission capacity in the groove arrangements shown in FIGS. 2(*a*) to (*c*). Here the computation result is shown which was roughly determined by the plate arrangement shown in FIG. 4. The groove angle (of the uppermost area and the bottom area) was changed from 10° to 20°, 30°, 40°, 50°, 60°, 70°, 80°, 90°, and 180°, the ratio of the groove pitch P to the groove depth D, i.e. D/P, at the same groove pitch was determined, and furthermore the heat emission capacity in the respective case was determined based on the above described formula 1.

Here an angle of 180° of the V-groove means a planar state without a groove. As a result of this computation it becomes apparent that in the arrangement provided with the V-grooves the emission capacity in each case is higher than in the arrangement without a V-groove. Furthermore it becomes apparent that at an angle of the V-groove of less than or equal to 30° a high value of the emission capacity with grooves of greater than or equal to 0.7 is obtained.

Next an attempt was made to measure the heat emission capacity for electrodes of the discharge lamp in order to prove the expectation based on the above described computation. In the test, four types of electrodes were produced, in which for cylindrical tungsten with a diameter of 20 mm and a total length of 40 mm the groove pitch P in all cases is 0.5 mm, and in which the groove depth was 0.5 mm, 0.75 mm, 1.0 mm and 1.5 mm. The temperature of these four electrodes was increased by high frequency heating up to roughly 2000° C., and the heat emission capacity was measured for the respective electrode. The measurement was taken using a pyrometer with a wavelength $\lambda$=0.68 microns.

FIG. 6 shows the test result. At a ratio D/P of the groove pitch P to the groove depth D of greater than or equal to 2, the emission capacity is 0.7. This shows that a greater effect can be obtained than in the case in which there is no groove.

Furthermore, the heat emission capacity was likewise measured in the electrode which was described above for the prior art using FIG. 9 and to which fine tungsten particles have been applied. Here the emission capacity was 0.6. This means that in the groove arrangement as claimed in the invention the heat emission capacity can be increased to 0.7 because D/P 2. This shows that it is higher than in the conventional case of application of fine tungsten particles. Also in the case of an arrangement of a groove area, depending on the groove angle, there are also cases in which the action is less than in the case of application of fine tungsten particles (for example, when P/D=1). This shows that not only the arrangement of the groove area, but also the groove pitch and groove depth thereof are extremely important.

As a process for producing the groove area there is a process using a diamond cutter, a process using irradiation with laser light, and a process using irradiation with electron beams. These processes can be effectively chosen and used depending on the groove distance.

In the case in which the groove distance is greater than or equal to roughly 500 microns and in which the groove depth is at least twice as great as the groove pitch, it is advantageous to use a diamond cutter with a V-shaped cutting tip. In the case in which the groove pitch is roughly 150 microns to 500 microns and the groove depth is roughly twice to three times as large as the groove pitch, laser machining by a pulsed laser or the like is suited. In this case the curved surfaces which are shown in FIG. 2(*c*) and which are formed in the bottom areas of the grooves can be produced by a suitable choice of the focal point of the laser light. In the case in which the groove pitch is less than or equal to 150 microns, it is advantageous to use electron beams.

The service life characteristic of a high pressure discharge lamp of the short arc type with an electrode as claimed in the invention is described below. In a discharge lamp with a groove arrangement as claimed in the invention and a discharge lamp with an electrode to which tungsten powder has been applied the relation between the duration of illumination and the illuminance was measured.

In the discharge lamp as claimed in the invention, the rated input power was 12 kW, the rated current was 120 A and the amount of mercury added was 24 mg/cm$^3$. In this lamp, xenon was used as the buffer gas. A cylindrical anode with a diameter of 29 mm, a total length of 60 mm, a diameter of the tip area of 10 mm and an opening angle of the conical part of 120° was used. The groove arrangement was produced by laser machining. The groove pitch was 200 microns, and the groove depth was 600 microns. This anode has the arrangement which is shown in FIG. 2(*a*). For comparison purposes, the same discharge lamp was used as the discharge lamp, except for the fact that instead of forming the groove area in the anode, tungsten powder was applied to the anode.

FIG. 7 shows the experimental result. Here the y-axis plots the illuminance ratio with respect to the illuminance when luminous operation starts and the x-axis plots the time progression of luminous operation. As is shown in the drawings, in the high pressure discharge lamp of the short arc type as claimed in the invention with respect to the degree of maintaining the illuminance a clear improvement compared to a conventional high pressure discharge lamp of the short arc type is apparent. This means that in a conventional high pressure discharge lamp of the short arc type the degree of maintenance of the illuminance after 200 hours of luminous operation was attenuated to less than or equal to 85%, while in the high pressure discharge lamp of the short arc type the degree of maintenance of the illuminance even after roughly 800 hours of luminous operation preserved a numerical value of roughly 90%.

This means that the groove arrangement of the electrode increases the heat emission capacity of the anode surface and causes the heat formed by lamp operation to be emitted with high efficiency. Therefore the anode temperature drops and moreover spraying and vaporization of the tungsten or the like by the anode are suppressed. As a result, its deposition on the emission tube is prevented. It is apparent that in this way high illuminance is maintained over a long time.

As was described above, by forming an electrode with a given groove depth and a given groove pitch the heat emission from this electrode can be greatly increased. But it was confirmed that depending on the groove arrangement the practical cross sectional area of the electrode is reduced and that in this way the probability of heat release by heat conduction from the electrode via the molybdenum foil and the outer terminal is reduced.

Generally, heat release by heat conduction is in a proportional relation to the cross sectional area of the electrode. It was confirmed that at an overly high groove depth with respect to the diameter of the electrode the heat emission characteristic of the electrode decreases even if the groove arrangement as in the invention is produced. Specifically heat conduction is prevented by reducing the cross sectional area when the groove depth with respect to the diameter of this electrode is greater than or equal to 12% in the groove arrangement. It was found that here the temperature of the electrode cannot be effectively reduced.

In the high pressure discharge lamp of the short arc type with the groove arrangement as claimed in the invention, with respect to the decrease of electrode temperature and the resulting degree of maintenance of the illuminance the effects were positive. But occasionally the arrangement of the grooves resulted in the disadvantage that when luminous operation starts an anomalous discharge occurs and that advantageous luminous operation cannot be carried out.

FIG. 8 shows groove depths and formations of anomalous discharges. It becomes apparent that anomalous discharges occur more frequently, the greater then groove depth. It can be imagined that the reason for this is that the electrical field is concentrated more often when the uppermost area which represents the tip of the groove area has an acute angle and that the glow discharge which is formed at the start of luminous operation forms in this uppermost tip area. It can furthermore by imagined that a glow discharge takes place more frequently by a hollow effect when the bottom area of the groove area has an acute angle.

It is advantageous as claimed in the invention to make the uppermost area and the bottom area of the groove area, not pointed, but curved flat in the manner shown in FIG. 2 (*c*) in order to reduce this formation of an anomalous discharge. It is sufficient when the radius of curvature is roughly 5 microns in one such curved flat surface. The purpose of one such curved flat surface is that sharp peaks are eliminated. Therefore, for electrodes in some examples as in FIG. 3 the curved flat shape can be used.

To produce one such curved surface with which the groove area is provided, for example the area with the acute angle of the outside peripheral surface is subjected to buffing and afterward electrolytic polishing in a sodium hydroxide liquid with a concentration of 10%. The bottom area of the groove can also be formed by the tip shape of for example a diamond cutter or the like which works the groove area being formed beforehand in a "round off the corner-shape". Furthermore, it can be formed by heat treatment at a high temperature in a vacuum. Specifically a curved surface can be produced by the grooves with a V-shaped arrangement being subjected to heat treatment for 120 minutes at 2000° C.

The groove arrangement as claimed in the invention is especially effective in a lamp with a high electrical input. It is effective specifically in a discharge lamp of the short arc type in which the input current for the discharge lamp is greater than or equal to 100 amps.

As was described above, by the high pressure discharge lamp of the short arc type by the measure that at least for one of the electrodes at least one part of its side is provided with a groove area with a given groove pitch and a given groove depth, it is possible to increase the heat emission capacity of this electrode and therefore even when the input power is increased for this discharge lamp to effect heat radiation with high efficiency. Therefore the amount of radiant light can be increased.

Area of Commercial Application

The high pressure discharge lamp of the short arc type as claimed in the invention can be used for example as a light source in a photolithography process which is a production process for a liquid crystal color filter.

What is claimed is:

1. A short arc-type, high pressure discharge lamp comprising:

an emission tube, a pair of electrodes arranged in spaced apart relationship inside the emission tube, wherein at least one of the electrodes has at least a portion of a surface of the electrode provided with a grooved area having grooves of a depth D that is less than or equal to 12% of a diameter of said portion of the surface of the electrode, and wherein a relation D/P between a depth D of the grooves and a pitch P between adjacent grooves is greater than or equal to 2.

2. A short arc-type, high pressure discharge lamp as set forth in claim 1, wherein the grooves are V-shaped.

3. A short arc-type, high pressure discharge lamp as set forth in claim 1, wherein, wherein each groove has a bottom area and an uppermost area formed with a curved surface.

4. A short arc-type, high pressure discharge lamp as set forth in claim 1, wherein at the least one of the electrodes is cylindrically shaped and has a conically shaped tip portion provided with a grooved area.

5. A short arc-type, high pressure discharge lamp as set forth in claim 1, wherein the grooves extend along a longitudinal axis of the at least one electrode.

6. A short arc-type, high pressure discharge lamp as set forth in claim 1, wherein the grooves extend circumferentially around a longitudinal axis of the at least one electrode.

7. A short arc-type, high pressure discharge lamp as set forth in claim 1, wherein the grooves comprise two sets of intersecting grooves.

8. A short arc-type, high pressure discharge lamp as set forth in claim 1, wherein the grooves are turns of a single spiral groove extending circumferentially around a longitudinal axis of the at least one electrode.

9. A short arc-type, high pressure discharge lamp as set forth in claim 1, wherein the grooves are randomly formed.

10. A short arc-type, high pressure discharge lamp as set forth in claim 1, wherein the at least one electrode is formed in the shape of a plate.

11. A short arc-type, high pressure discharge lamp as set forth in claim 1, wherein the at least one electrode has cylindrical shape.

* * * * *